US008308385B2

(12) United States Patent
Wu et al.

(10) Patent No.: US 8,308,385 B2
(45) Date of Patent: Nov. 13, 2012

(54) ATOMIZER HAVING AUXILIARY DISPENSER AND MANUFACTURING METHOD OF THE SAME

(75) Inventors: Yao Kuang Wu, Xizhi (TW); Wen Pao Tseng, Xizhi (TW)

(73) Assignee: Sanyo Machinery Co., Ltd., Xizhi (TW)

( * ) Notice: Subject to any disclaimer, the term of this patent is extended or adjusted under 35 U.S.C. 154(b) by 876 days.

(21) Appl. No.: 12/354,806

(22) Filed: Jan. 16, 2009

(65) Prior Publication Data

US 2009/0184177 A1 Jul. 23, 2009

(30) Foreign Application Priority Data

Jan. 18, 2008 (TW) ..... 97101864 A

(51) Int. Cl.
*A46B 11/02* (2006.01)

(52) U.S. Cl. ..... 401/188 R

(58) Field of Classification Search ..... 401/188 R, 401/187; 222/383.1, 372, 331, 482
See application file for complete search history.

(56) References Cited

U.S. PATENT DOCUMENTS 4,614,284 A * 9/1986 Miles ..... 222/331
4,618,076 A * 10/1986 Silvenis ..... 222/331
5,542,581 A * 8/1996 Habora et al. ..... 222/331
5,788,125 A * 8/1998 Steiner et al. ..... 222/331

* cited by examiner

*Primary Examiner* — Huyen Le
(74) *Attorney, Agent, or Firm* — Connolly Bove Lodge & Hutz LLP

(57) ABSTRACT

An atomizer having an auxiliary dispenser is provided. The atomizer is coupled to a container filled with a liquid. The auxiliary dispenser is designed according to a preferred dispensing manner of the liquid so that the liquid is more efficiently appropriately dispensed. The auxiliary dispenser includes a connecting member disposed on an atomizer body, and a dispensing unit having a coupling portion for coupling with the connecting member. The liquid is released from the connecting member. The dispensing unit receives and further dispenses the liquid.

A manufacturing method of the atomizer is further provided. A second outlet is disposed on the atomizer body, and the connecting member is configured at the second outlet. A series of different dispensing units are manufactured according to the types and preferred dispensing manners of different liquids, and each dispensing unit includes a coupling portion for coupling to the connecting member.

24 Claims, 10 Drawing Sheets

ATOMIZER HAVING AUXILIARY DISPENSER AND MANUFACTURING METHOD OF THE SAME

FIELD OF THE INVENTION

The present invention relates to a trigger-actuated pumping atomizer that is coupled to a container to be used, and more particularly to an atomizer provided with an auxiliary dispenser, in which the dispenser is designed according to a preferred dispensing manner of a liquid filled in the container so that the liquid filled in the container can be more appropriately dispensed.

DESCRIPTION OF THE PRIOR ART

A conventional trigger-actuated pumping atomizer is shown in FIG. 7, which is coupled to a container 1 filled with a liquid 99, so as to dispense and release the liquid by pumping it into atomized form.

An atomizer 80 has a trigger-actuated pump P, and a pumping flow path in fluid communication with the pump P. A trigger 8 can actuate a pump member 6*c* to perform a piston motion and thus has a pumping effect that alternately generates negative pressure in the pump chamber 6 and positive pressure in the pump chamber 6. When negative pressure is generated, the liquid 99 is sucked into the pump chamber 6 to be temporarily stored in the pump chamber 6 through a through-hole 6*a* of the pump chamber via a suction pipe 91 and an inlet check valve 86 of the pumping flow path. When positive pressure is generated, the liquid in the pump chamber 6 is expelled through the through-hole 6*a*, and then atomized and dispersed from an atomizing nozzle 84 via an outlet check valve 83 of the pumping flow path.

During the above pumping process, in order to prevent vacuum in an inner part of the container after the liquid is released, a vent hole 6*b* which is sealed by a pump member 6*c* under the normal state is disposed at the cylinder body 4 of the pump chamber 6. When the pump member 6*c* is pushed by the trigger 8 to reach a second position, the air from outside can enter the container via the vent hole 6*b* to prevent vacuum.

The advantage of the pumping atomizer lies in dispensing and releasing the liquid in the container by means of atomizing. However, in practice, it is not always necessary to dispense liquid by means of atomizing. In addition, the pumping atomizer has the following disadvantages in certain situations.

For example, when the pumping atomizer is used to dispense a food seasoning, the seasoning can be uniformly atomized on a surface of a pan, but a large amount is needed, the user has to pull the trigger many times. Furthermore, if a small amount of seasoning is needed in a small dish, the seasoning will easily spread out of the small dish.

When the pumping atomizer is used to dispense a processing agent, such as cutting compound, lubricant, rust remover, or antirust agent on a small object (for example, small hinge, coupler, small bearer, groove, screw thread, or void of an equipment), the processing agent may accidentally spread to other parts, thereby contaminating the other parts.

Furthermore, when the pumping atomizer is used to dispense a detergent to a low operating area (for example, inner and outer edges of a bathtub or toilet bowl, a lower edge of bathroom equipment or a wall, etc.), due to the height of the container, the user needs to hold the container at an angle between a horizontal position and an upside-down position. However, when the container is held at such an angle, the detergent in the container flows towards the atomizer, so the inlet of the suction pipe is higher than the liquid surface and exposed, and as a result, the liquid cannot be sucked into the suction pipe and the atomizing operation is interrupted. In addition, when the trigger 8 is pulled, the pump member 6*c* is pushed to the second position, so the detergent may leak from the vent hole 6*b*, thereby contaminating the fingers of the user.

Furthermore, when the pumping atomizer is used to dispense a detergent to a lower wide operating area (for example, a desk top, table top, and floor), the container is held at a horizontal angle, so the liquid is atomized with the atomizing nozzle facing downwards. However, when the trigger 8 is pulled to push the pump member 6*c* at such an angle, the detergent in the container can leak from the vent hole 6*b*.

Furthermore, when the pumping atomizer is used to dispense a detergent to an operating area adjacent to other objects, the detergent can accidentally spread to the other objects. As a result, the user will need to spend time in cleaning the contaminated objects.

Furthermore, when the pumping atomizer is used to dispense a detergent to a vertical operating area (for example, a wall surface of a bathroom or kitchen, surface of a mirror or equipment, window glass, etc.), the detergent can flow down. As a result, not only is it difficult to achieve the cleaning effect, but also the detergent is wasted.

Furthermore, if the detergent is continuously dispensed by means of atomizing for a long time, the detergent particles can spread in the air, which is harmful to the health of the user.

In addition, when the liquid level is too low for the suction pipe to reach, the liquid is left in the container, which is not only wasteful but also violates the environmental protection rules.

SUMMARY OF THE INVENTION

As described above, the pumping atomizer is not suitable for dispensing liquid in certain situations. Different liquids are most efficiently dispensed in different manners, so if the manufacturer intends to produce various dispensers with different functions, shapes, and sizes, it needs to invest a lot of money in many different types of complicated molds and fixtures and provide a large space to store a great number of finished products, which will greatly increase the cost.

The present invention is directed to an atomizer having an auxiliary dispenser. The atomizer is coupled to a container filled with a liquid, and generally has a conventional trigger-actuated pumping and atomizing dispenser. The auxiliary dispenser is designed according to a preferred dispensing manner of the liquid filled in the container so that the liquid in the container can be more appropriately dispensed.

The auxiliary dispenser includes a connecting member, an outflow path, and a dispensing unit. The connecting member has a hole, and is integrally mounted on the upper part of the atomizer body. The outflow path is provided within the atomizer body, and is connected outwards to the hole and connected inwards to the inner part of the container. When the container is held at an angle between a horizontal position and an upside-down position and is squeezed, the liquid in the container is released from the hole through the outflow path. The dispensing unit includes a coupling portion for coupling to the connecting member, which is coupled to the connecting member to further dispense the liquid released from the hole.

The present invention is further directed to a manufacturing method of an atomizer having an auxiliary dispenser. It is suitable for mass production of an atomizer at a low cost. Therefore, the atomizer is of a modularized design and has a second outlet, the connecting member is disposed at the second outlet, and a series of dispensing units are manufactured according to the types and dispensing requirements of various liquids. With the connecting member designed in a modularized manner, the manufacturer can select a suitable dispensing unit from a series of dispensing units to couple with the connecting member according to the actual needs, thereby achieving mass production of an atomizer having an auxiliary dispenser at a lower cost.

Preferably, the dispensing unit includes an axial outflow nozzle for dispensing the liquid so that the atomizer has an axial-outflowing auxiliary dispensing function.

Preferably, the dispensing unit includes a radial releasing portion for dispensing or spraying the liquid, so that the atomizer further has a radial outflowing or atomizing auxiliary dispensing function.

Preferably, the dispensing unit includes a brushing or daubing body so that the atomizer further has a brushing or daubing auxiliary function.

Preferably, the auxiliary dispenser further includes a cleaning tool with a brushing or daubing body. The cleaning tool can be used separately, and can be further attached to the outflow nozzle of the dispensing unit or the atomizing nozzle of the pumping and atomizing dispenser in a dismountable manner, so that the atomizer further has a diversified brushing or daubing auxiliary dispensing function.

The auxiliary dispenser does not rely on a pump to dispense liquid, so that the problems with the conventional pumping atomizer will not occur. In addition, when the liquid level in the container is so low that the suction pipe cannot reach the liquid, the liquid can still be used by adding an auxiliary dispenser. In this manner, not only is the liquid not wasted, but also the container will not have any liquid remaining therein, thereby meeting the environmental protection requirements.

In order to make the above and other objectives, features, and advantages of the present invention easier to understand, a detailed description is given below with reference to the embodiments and accompanying drawings.

DETAILED DESCRIPTION

Figure 1:
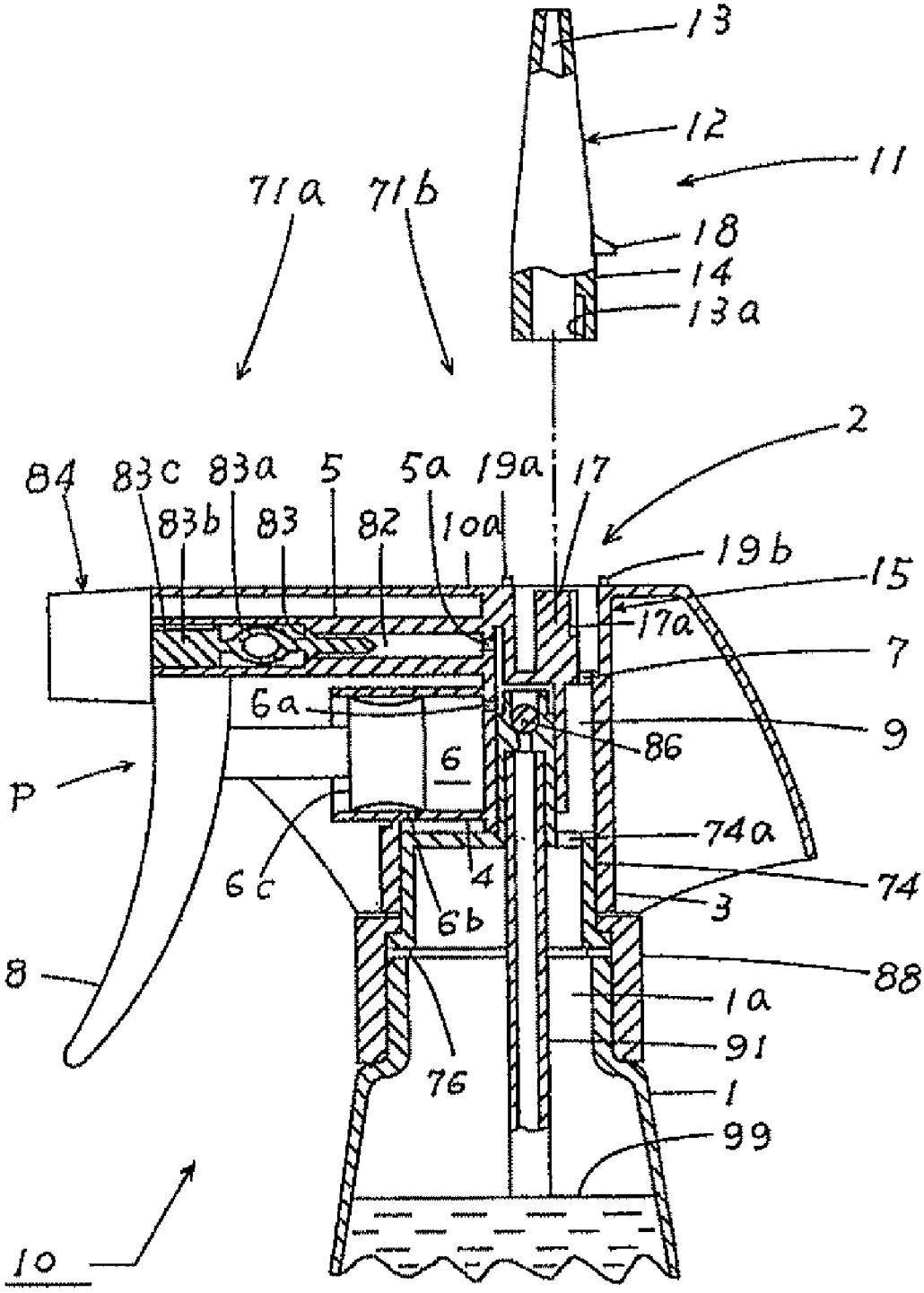
FIG. 1 is a lateral partial cross-sectional view of an atomizer having an auxiliary dispenser according to a first preferred embodiment of the present invention, in which a connecting member in the shape of a cylindrical slot is configured at the second outlet of an atomizer body, and a dispensing unit having an outflow nozzle and a coupling portion is ready to be coupled to the cylindrical slot.

FIG. 1 shows an atomizer having an auxiliary dispenser (hereafter referred to as an atomizer) 10 according to a first preferred embodiment of the present invention, which has a body 10*a* molded from a flexible plastic. The body 10*a* is attached to an axially standing container 1 filled with a liquid 99. A circular cap 74 locked by an annular fastener 88 is disposed on an upper opening 1*a* of the container, and an upper part of the cap 74 axially extends and protrudes upwards to provide a sleeve pipe 3 at the bottom of the atomizer body 10*a* to closely fit thereto.

Figure 7:
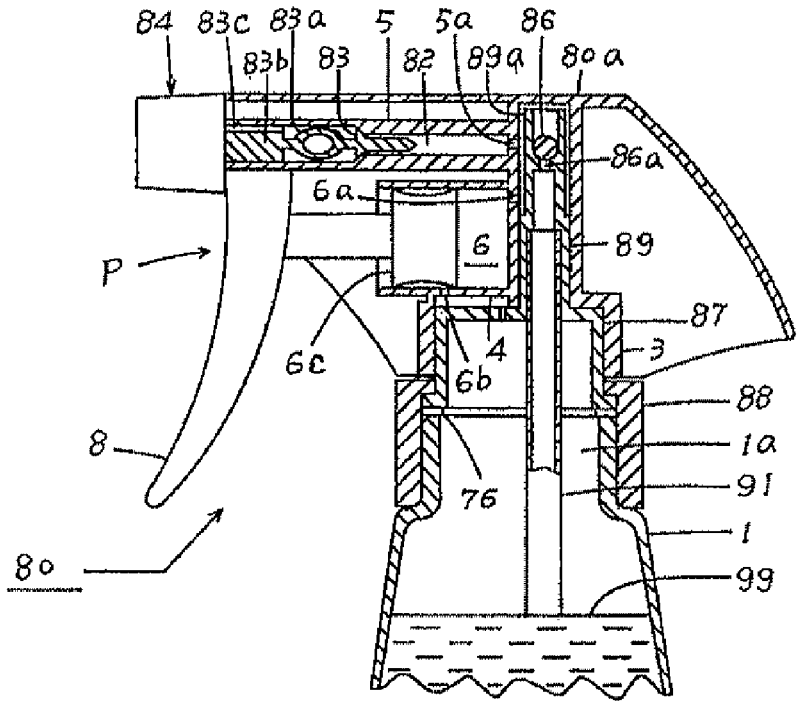
FIG. 7 is a lateral partial cross-sectional view of a conventional atomizer.

Similar to the conventional atomizer body 80*a* shown in FIG. 7, the atomizer body 10*a* has pipelines and elements that are provided for a conventional atomizer, such that the atomizer 10 can be provided with a conventional trigger-actuated pumping and atomizing dispenser. The dispenser includes a trigger-actuated pump P having a pumping function, and a pumping flow path having an atomizing nozzle 84 and a suction pipe 91. Due to the pumping function of the pump 9, the liquid 99 in the container can enter the suction pipe 91 via the inlet (not shown) at the bottom of the suction pipe 91, then flows upwards along the suction pipe 91 and passes through the pumping flow path, and finally is dispensed from the atomizing nozzle 84 by means of atomizing.

The liquid 99 in the container is selected from liquid products that are usually dispensed by atomizing, for example, detergent, rinsing agent, brightener, deodorant, disinfectant, insecticide, horticultural cultivation agent, flavoring agent, food seasoning, cutting compound, lubricant, release agent, rust remover, or antirust agent.

The auxiliary dispenser of the atomizer 10 includes a connecting member 2, an outflow path 9, and a dispensing unit 11. The connecting member 2 is integrally formed at an upper part of the atomizer body 10*a* and has a hole 7. The outflow path 9 is formed within the atomizer body 10*a*, connected outwards to the hole 7, and connected inwards to an inner part of the container via a through-hole 74*a* disposed on the cap 74 of the container, so that the liquid 99 in the container can be released from the hole 7 through the outflow path 9. The dispensing unit 11 includes a coupling portion 14 for coupling to the connecting member 2, and thus the liquid 99 is released from the hole 7.

The dispensing unit 11 further includes a frustum-shaped outflow nozzle 12 axially extending upwards from the coupling portion 14, and a channel 13 penetrating both the coupling portion 14 and the outflow nozzle 12. The channel 13 is used to receive the liquid released from the hole 7 and then dispense the liquid.

The diameter of the channel 13 at an outlet of the outflow nozzle 12 preferably is between 1 mm and 6 mm. Within such diameter range, the released liquid can be dispensed in a controlled flow. The dispensing unit 11 is a single member, which has a simple structure and can be easily molded, so that a series of dispensing units 11 with different aperture specifications for dispensing various liquids can be mass-produced at a low cost.

The outflow nozzle 12 can also be in a tapered shape without an outlet, letting user cut an outlet with an appropriate aperture diameter according to their need.

If the atomizer 10 is used to dispense an edible liquid, it can be provide with a cap on the outlet of the outflow nozzle 12 through a conventional technique for the purpose of sanitation.

The connecting member 2 is preferably designed to have a cylindrical slot 15 which is axially recessed from the top of the atomizer body 10*a*, so that the dispensing unit 11 can be easily inserted from top to bottom and operated. In the preferred embodiment, the hole 7 is provided on the bottom wall of the cylindrical slot 15, so that when the coupling portion 14 is inserted into the cylindrical slot 15, the outflow path 9 can be in fluid communication with the channel 13 through the hole 7.

Figure 1A:
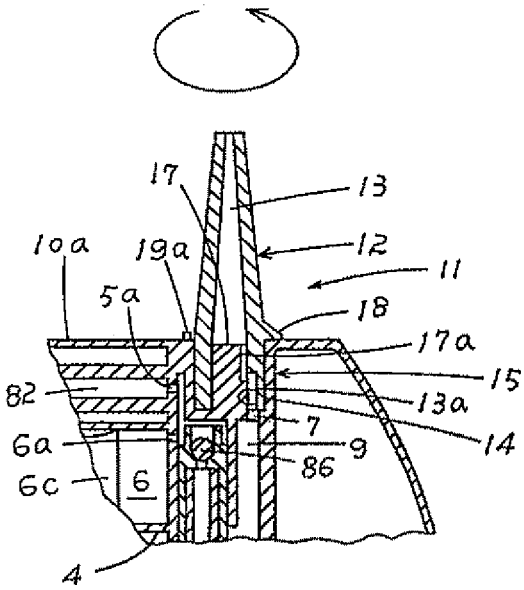
FIG. 1A shows the coupling portion of the dispensing unit in FIG. 1 combined within a socket, in which a flow path between a cavity and a hole is in an open state.
Figure 1B:
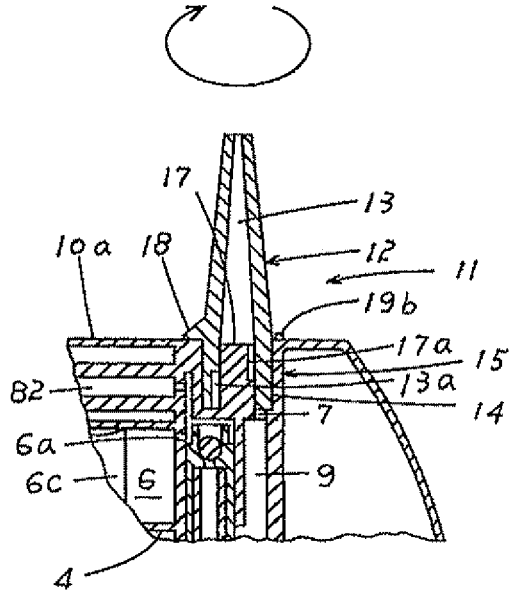
FIG. 1B shows the dispensing unit of FIG. 1A rotated to the position of a first angle, in which the flow path between the cavity and the hole is in a closed state.

The auxiliary dispenser further includes a mechanism for opening/closing the flow path, as shown in FIGS. 1A and 1B. The mechanism changes the open/closed state of the flow path between the hole 7 and the channel 13 by rotating the dispensing unit 11. The coupling portion 14 of the dispensing unit 1 can be rotatably inserted into the cylindrical slot 15, so that the dispensing unit 11 is manipulated to rotate between a first angle and a second angle, thereby changing the flow path.

The mechanism for opening/closing the flow path includes a circular plunger 17, an outer-edge channel 17*a*, and an inner-edge channel 13*a*. The circular plunger 17 axially protrudes upwards from the bottom wall of the cylindrical slot 15, so as to be rotatably and liquid-tightly fitted with the lower part of the channel 13 of the outflow nozzle 12. The inner-edge channel 13*a* and the outer-edge channel 17*a* are formed on contacting surfaces of the channel 13 and the circular plunger 17, respectively. The positions of the two recesses 13*a* and 17*a* are are selected in such a way that when the dispensing unit 11 is rotated to the position of the second angle, the two recesses are aligned with each other to form a channel, so that the hole 7 can be in fluid communication with the channel 13 through the channel (as shown in FIG. 1A). When the dispensing unit 11 is rotated to the position of the first angle, the two recesses are staggered, so that the flow path between the hole 7 and the channel 13 is shut off (as shown in FIG. 1B).

In order to rotate the dispensing unit 11 to a predetermined position, an indicating and stopping block 18 with both indicating and stopping functions is disposed at an outer circumference of the outflow nozzle 12. In addition, a first positioning part 19*a* and a second positioning part 19*b* are disposed on the top of the atomizer body 10*a*, and "OFF" and "ON" marks (not shown) are formed besides the first positioning part 19*a* and the second positioning part 19*b*, respectively. In this way, when the dispensing unit 11 is rotated to the first angle, the indicating and stopping block 18 is stopped by the first positioning part and points at the "OFF" mark, which indicates that the flow path is shut off. When the dispensing unit 11 is rotated to the second angle, the indicating and stopping block 18 is stopped by the second positioning part and points at the "ON" mark, which indicates that the flow path is open.

Figure 1C:
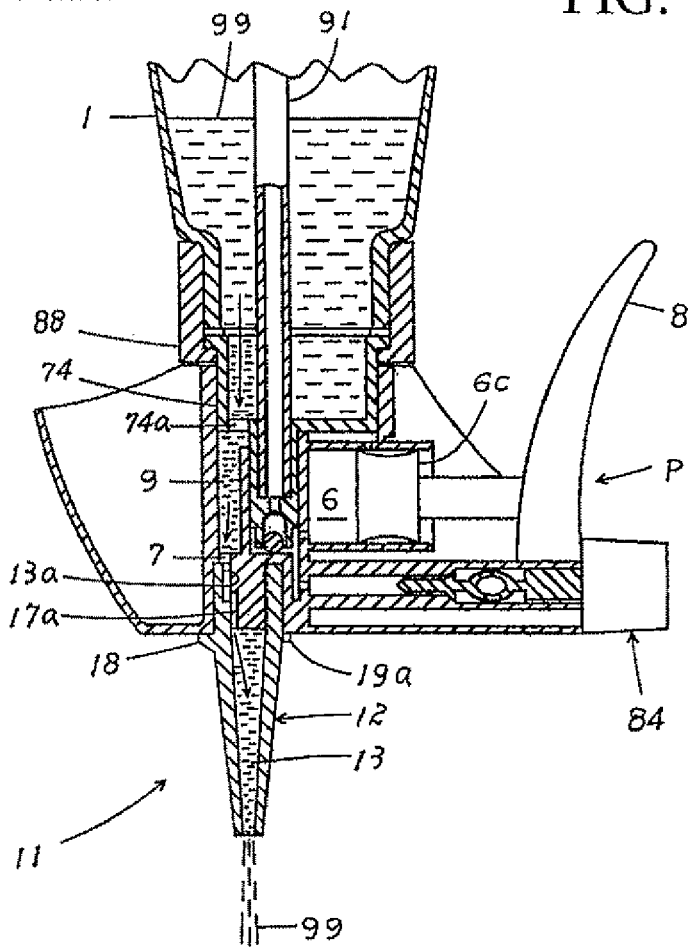
FIG. 1C shows the liquid being dispensed downwards via the outflow nozzle.

As for the operations of the auxiliary dispenser, as shown in FIG. 1C, the user holds the container at an upside-down angle, and squeezes the container shell with a hand. Under the compression force generated after the shell is squeezed and deformed, the liquid 99 in the container flows downwards to the exterior via the opening of the outflow nozzle 12 the through-hole 74*a* of the cap, the outflow path 9, the hole 7, the inner-edge channel 13*a*, the outer-edge channel 17*a*, and the channel 13 in sequence along a direction indicated by the arrow.

The advantages of such an auxiliary dispensing manner by means of outflowing include the following. When the liquid 99 is a food seasoning, it can be simply, conveniently, and quickly dispensed through the outflow nozzle 12 into the pan, or accurately dispensed in an appropriate amount to a small dish or a surface of food held in one hand. Furthermore, when the liquid 99 is, for example, cutting compound, lubricant, rust remover, antirust agent, or other processing agent, it can be accurately dispensed through the outflow nozzle 12 onto a small working object (for example, small hinge, coupler, small bearer, groove, screw thread, or void of various equipment).

The shell of the container can be made of a material that is flexible and can recover after being squeezed and deformed. Once the force exerted to squeeze the shell is removed, the shell can automatically resume its original shape.

Figure 2:
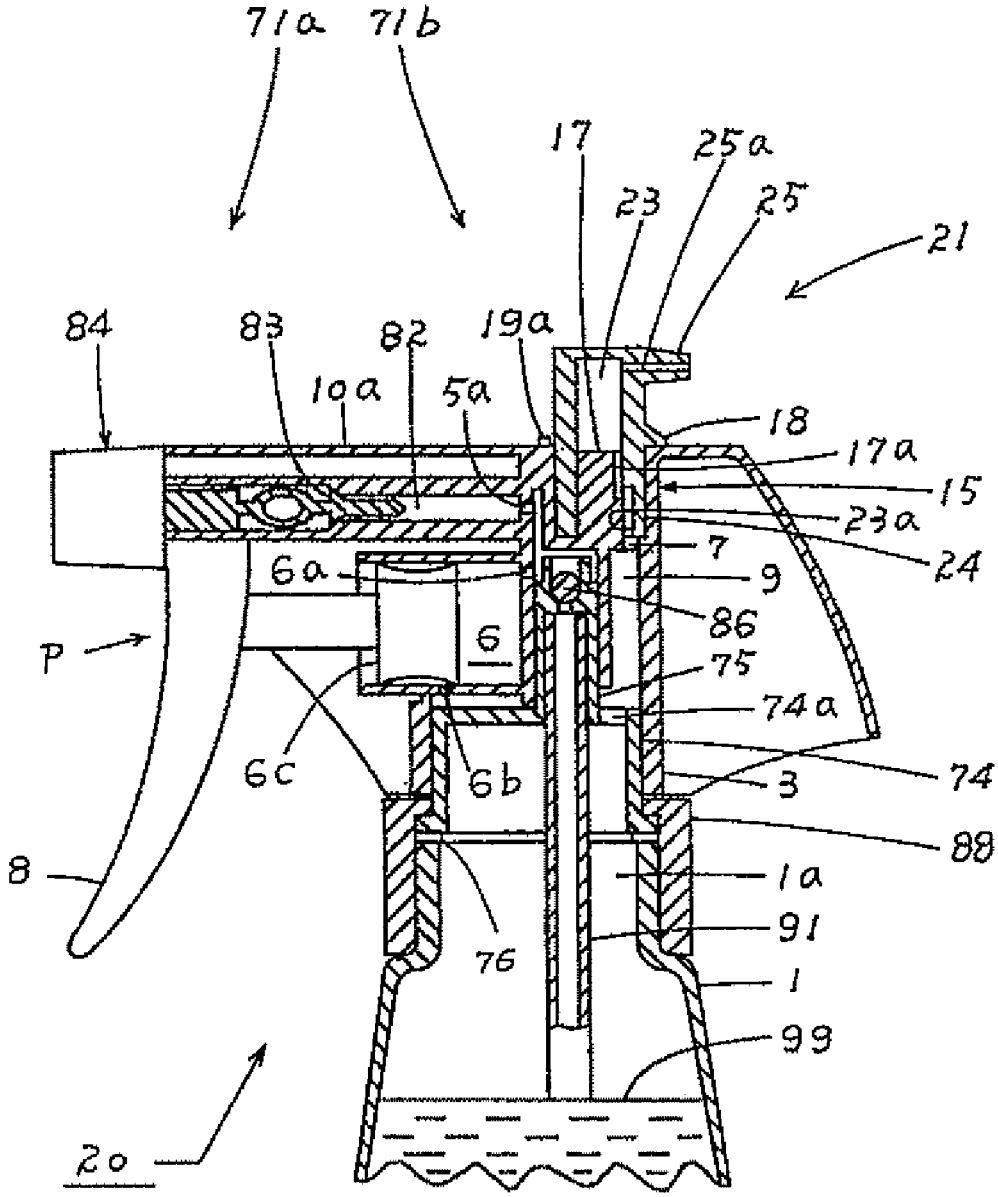
FIG. 2 shows a second preferred embodiment of the present invention, in which the outflow nozzle in FIG. 1 is bent to form a radial releasing portion.
Figure 2A:
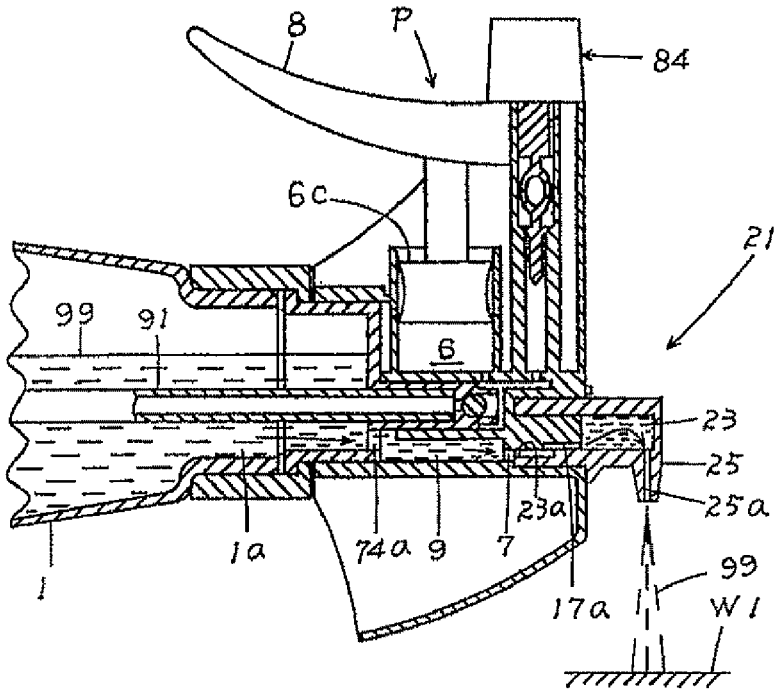
FIG. 2A shows the container operated at a horizontal angle, in which the liquid is dispensed and released downwards via the radial releasing portion.
Figure 2B:
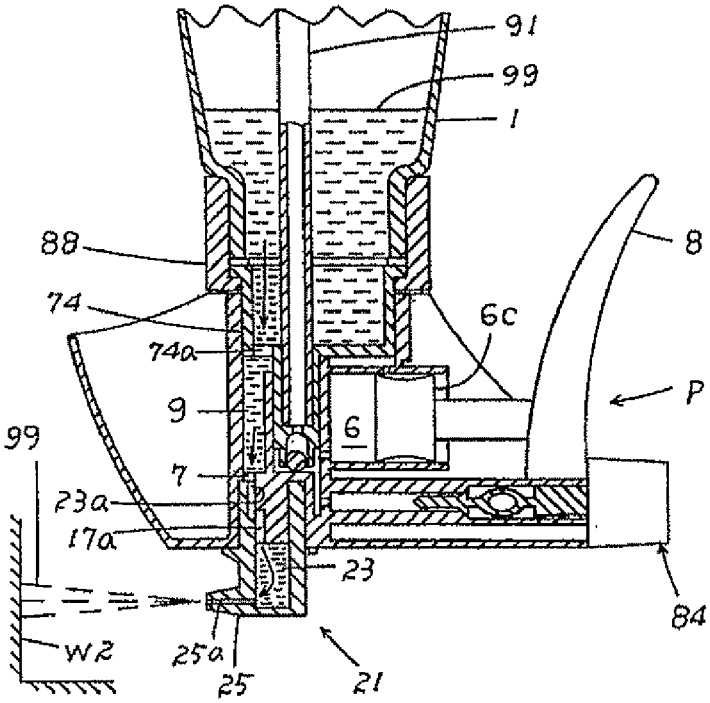
FIG. 2B shows the container operated at an upside-down angle, in which the liquid is dispensed and released towards a lateral side via the radial releasing portion.

FIGS. 2 to 2B show an atomizer 20 according to a second preferred embodiment which is similar to that of FIG. 1, except that an upper section of the outflow nozzle 12 in FIG. 1 is radially bent to form a radial releasing portion 25 in this embodiment.

The radial releasing portion 25 is provided with a radial hole 25*a* connected to the cavity 23, and the bending angle thereof is between 45 degrees and 90 degrees.

The operations of the auxiliary dispenser of the atomizer 20 are approximately the same as those of the atomizer shown in FIG. 1C. When the shell of the container is squeezed, the liquid 99 in the container is radially released via the radial hole 25*a*.

In a preferred dispensing mode, the diameter of the radial hole 25*a* is between 1 mm and 6 mm. Within such the diameter range, the released liquid can be dispensed in a controlled flow. The operations and advantages of this dispensing manner is shown in FIG. 1C.

In another preferred dispensing mode, the diameter of the radial hole 25*a* is between 0.1 mm and 1 mm. Within such the diameter range, the released liquid is dispensed in the form of spray. The operation thereof is shown in FIG. 2A, in which the container is operated at a horizontal angle, and the liquid 99 in the container flows along the direction indicated by the arrow and finally is atomized downwards via the radial hole 25*a* to reach an object W1 located under the container. The operation thereof is also shown in FIG. 2B, in which the container is operated at an upside-down angle, and the liquid 99 in the container is sprayed towards the lateral side via the radial hole 25*a* to reach an object W2 located on the lateral side.

The advantages of such an auxiliary dispensing manner by means of squeezing and atomizing include the following. When the shell of the container is squeezed, the detergent is easily sprayed from the radial hole 25*a*, so it is particularly suitable for dispensing detergent to a lower wide operating area (for example, desk top, table top, and floor). Furthermore, the liquid is radially sprayed from the radial hole 25*a*, so it is particularly suitable for dispensing detergent to a narrow or low operating area (for example, inner and outer edges of a bathtub or toilet bowl, a lower edge of a bathroom equipment or a wall, etc.). Compared with the conventional pumping and atomizing manner, it is much quicker and more convenient and does not rely on the suction pipe 91 to deliver the liquid, so the spraying operation will not be interrupted. In addition, the trigger is not pulled, so the liquid in the container will not leak from the vent hole 6*b*.

Figure 3:
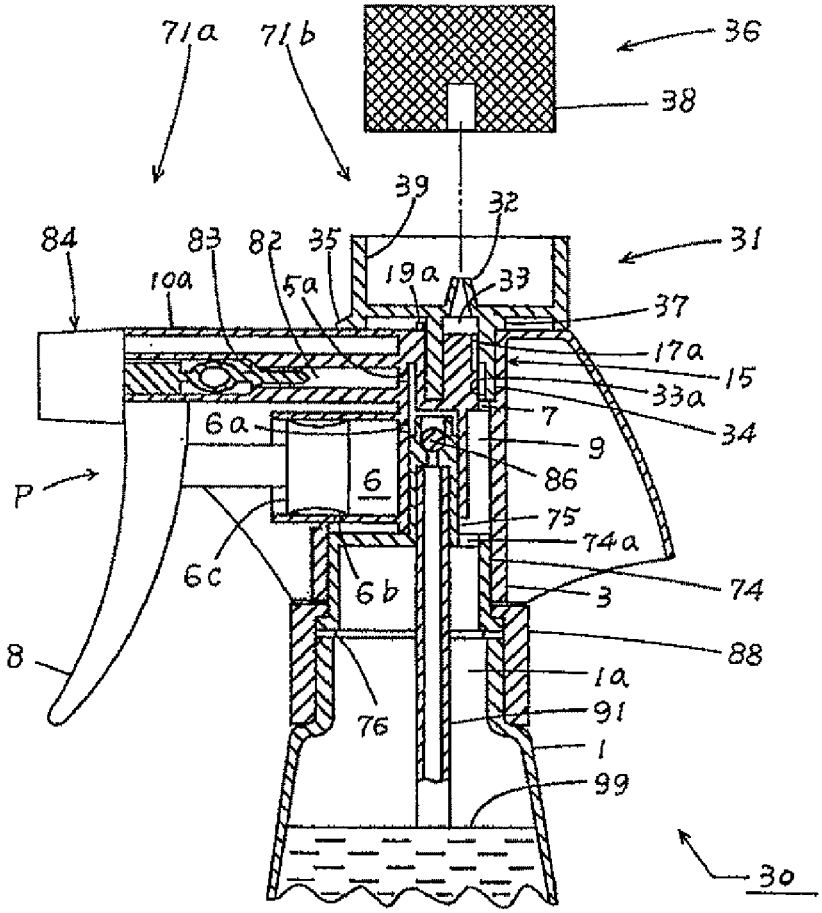
FIG. 3 shows a third preferred embodiment of the present invention, in which a brushing or daubing body is ready to be disposed in a hollow holder of the dispensing unit.
Figure 3A:
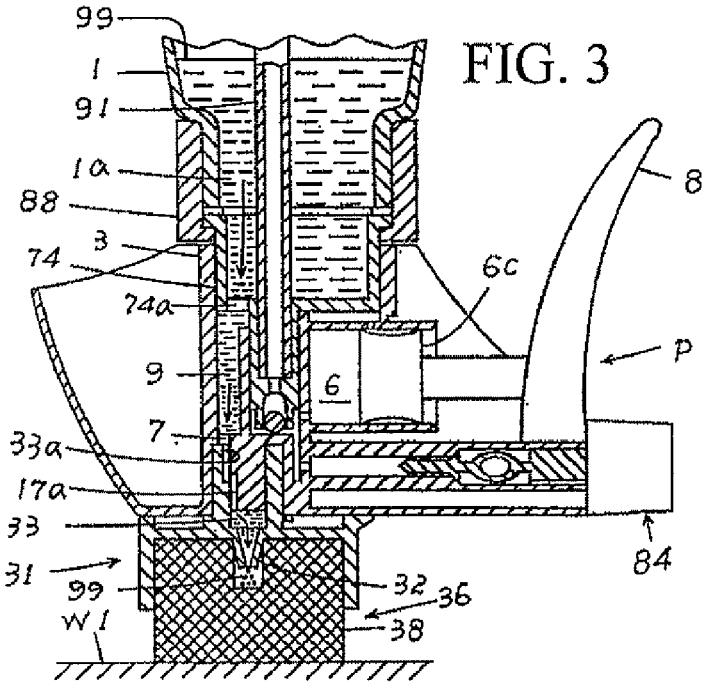
FIG. 3A shows dispensing by using the brushing or daubing body shown in FIG. 3.

FIGS. 3 and 3A shows an atomizer 30 according to a third preferred embodiment which is similar to that of FIG. 1, except that a dispensing unit 31 further includes a hollow holder 39 and a brushing or daubing body 36 disposed at the hollow holder 39.

In addition, the indicating and stopping block 18 disposed at the outer edge of the outflow nozzle 12 in FIG. 1 is separately disposed in this embodiment, and as shown in FIG. 3, the stopper 37 is kept at the original position, but the indicator 35 is moved to the outer edge of the hollow holder 39.

The hollow holder 39 radially extends outwards from an outer periphery of the outflow nozzle 32, and axially extends upwards, so as to form a circumferential wall for receiving the brushing or daubing body 36. When the brushing or daubing body 36 is mounted in the hollow holder 39, the outflow nozzle 32 is surrounded therein.

Preferably, the brushing or daubing body 36 can be dismounted from the hollow holder 39, so that the user can easily rinse or replace the brushing or daubing body 36. Preferably, the brushing or daubing body 36 is, for example, removably disposed on the hollow holder 39 through a conventional technique, such as fastening, frictionial engagement, and the like.

The brushing or daubing body 36 is preferably an object having brushing or daubing function, for example, brush hair, rubber strip, steel wire, sponge, polyester fiber, cotton fiber, or non-woven fabric. The brushing or daubing body 36 shown in the drawing is exemplified as a sponge 38 disposed on the hollow holder 39. The outer dimension of the sponge 38 is slightly larger than the inner dimension of the hollow holder 39, so that the lower part of the sponge 38 is removably fitted into the inner part of the hollow holder 39 through friction engagement.

The overall axial cross-section of the hollow holder 39 and the brushing or daubing body 36 can be molded into different geometrical shapes suitable for the brushing or daubing operations, according to the type and dispensing requirement of the liquid 99 in the container, for example, circular, elliptic, or polygonal shape.

The operations of the auxiliary dispenser of the atomizer 30 are approximately the same as those shown in FIG. 1C. As shown in FIG. 3A, the container is operated at an upside-down angle, the liquid 99 flows to the outflow nozzle 32 along a direction indicated by the arrow and is dispensed downwards, and the dispensed liquid passes through the pores of the brushing or daubing body 36 and is brushed or daubed onto the object W1 located under the container.

The advantages of the auxiliary dispensing manner by means of brushing or daubing include the following. Through the daubing function of the brushing or daubing body 36, the detergent can be accurately dispensed to an operating area adjacent to other objects during the dispensing process, which not only avoids the problem of accidentally spreading the detergent to the other objects, but also cleans the stains on the operating area through the brushing function of the brushing or daubing body 36.

Figure 4:
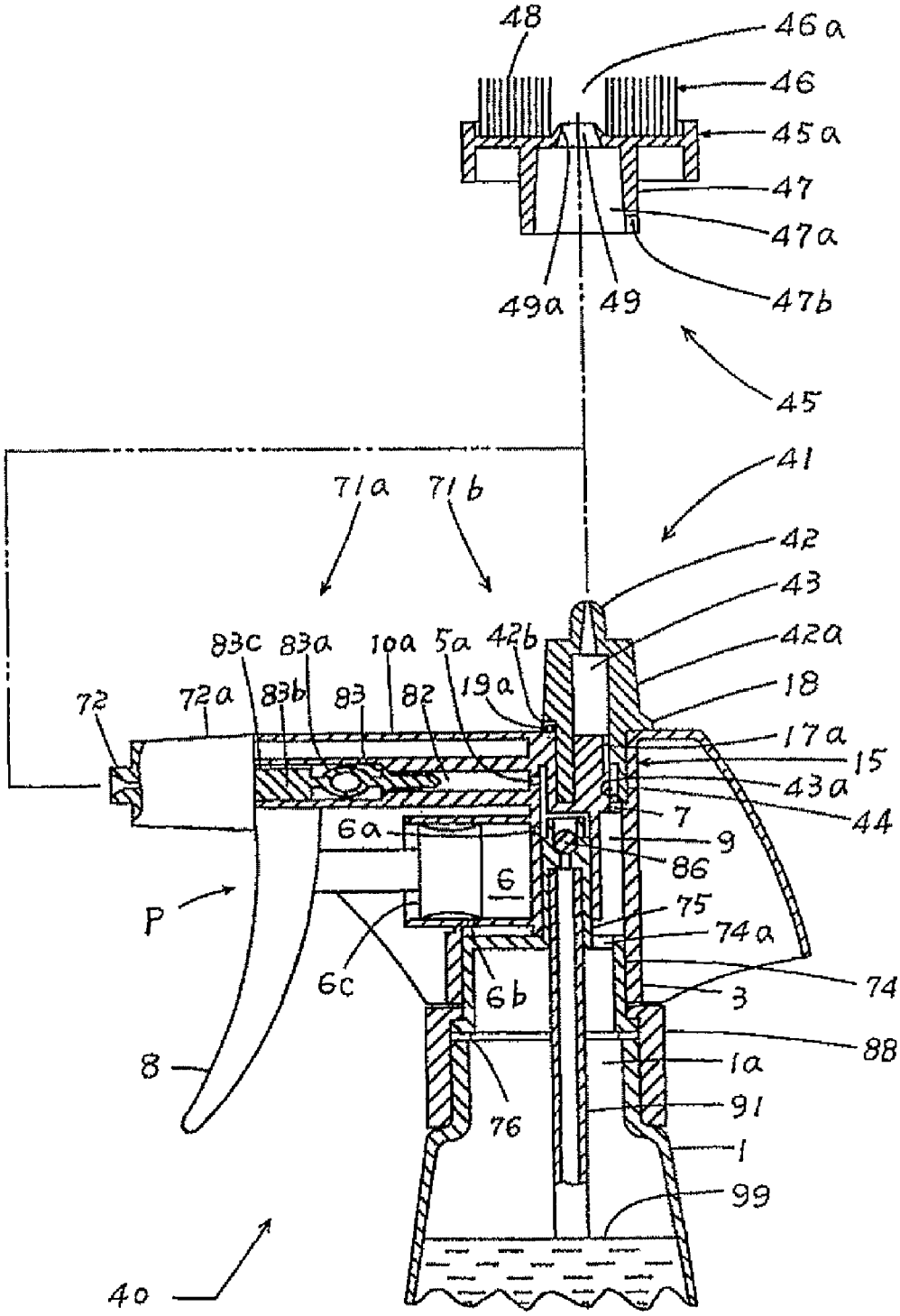
FIG. 4 shows a fourth preferred embodiment of the present invention, in which a cleaning tool is ready to be fitted on the outflow nozzle or an atomizing nozzle.
Figure 4A:
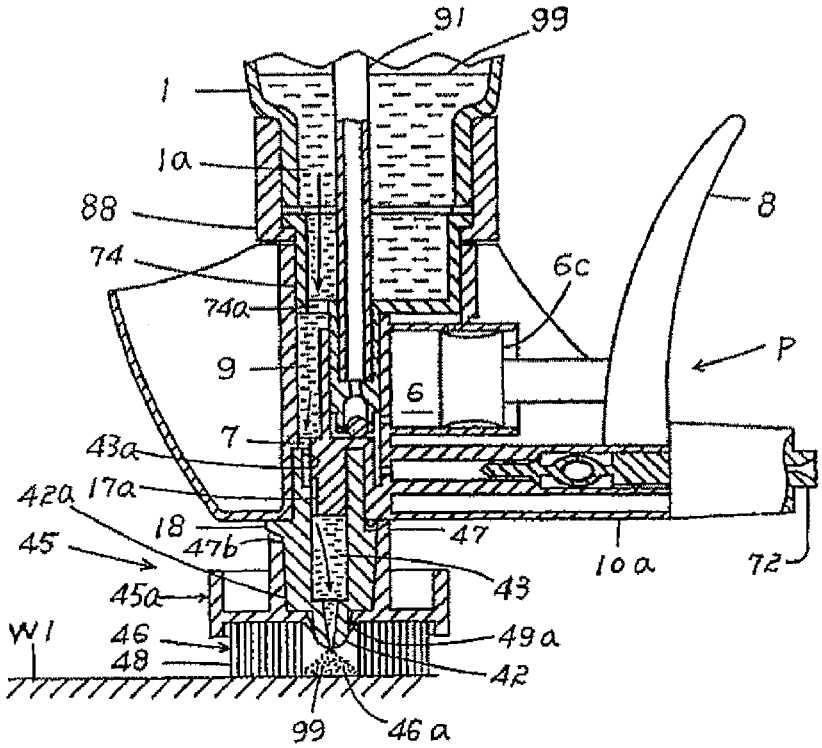
FIG. 4A shows the cleaning tool in FIG. 4 fitted on the outflow nozzle, in which the liquid is dispensed by brushing or daubing.
Figure 4B:
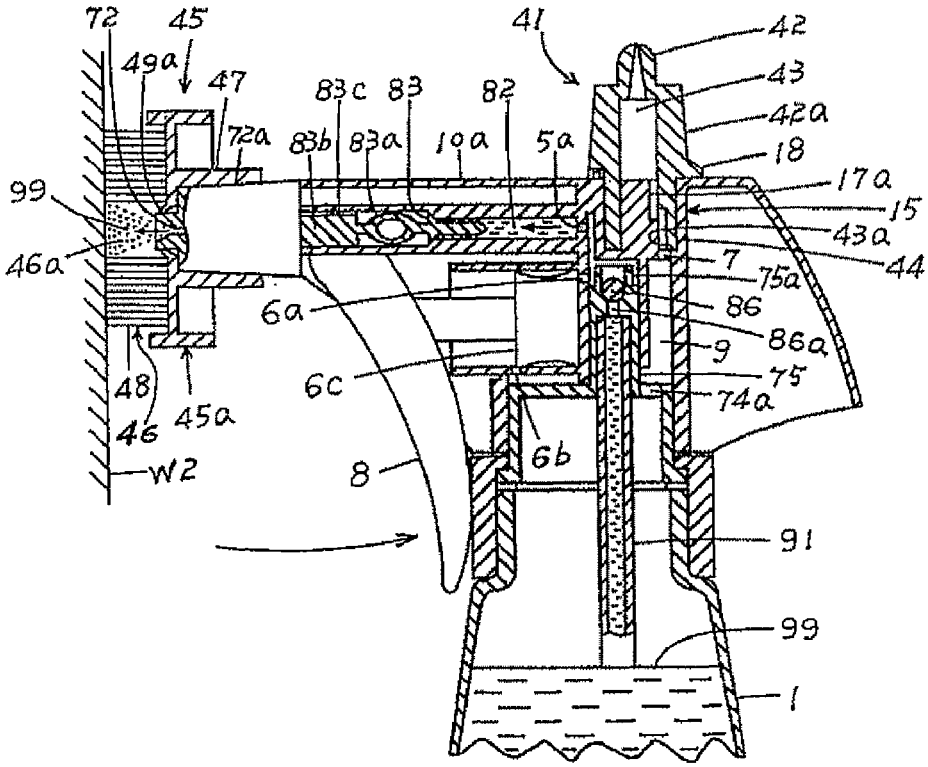
FIG. 4B shows the cleaning tool of FIG. 4A fitted on the atomizing nozzle, in which the liquid is dispensed by brushing or daubing.

FIGS. 4 to 4B show an atomizer 40 according to a fourth preferred embodiment which is similar to that of FIG. 1, except that an outflow nozzle 42 of a dispensing unit 41 has a circular cross-section, and most of the parts are configured into a tapered profile 42*a*. In addition, the auxiliary dispenser further includes a cleaning tool 45 capable of being coupled to the outflow nozzle 42.

The tapered profile 42*a* has a polygonal axial cross-section, for example, triangular or square, making it easy for the user to open/close the flow path through rotating.

The bottom of the tapered profile 42*a* is configured with a recessed shoulder 42*b* not to interfere with the first positioning part 19*a* and the second positioning part 19*b*, so that the dispensing unit 41 can be surely inserted in the cylindrical slot 15.

The cleaning tool 45 includes a body 45*a*, a brushing or daubing body 46 disposed on the top of the body 45*a* and having a reserved hollow part 46*a*, and a coupling portion 47 disposed at the bottom of the body 45*a*.

The inner part of the coupling portion 47 has a cavity 47*a* for being fitted with the tapered profile 42*a*, and the bottom part thereof has a hollow holder cut 47*b* for avoiding indicating and stopping block 18, such that the cleaning tool 45 can be securely combined with the outflow nozzle 42.

The cleaning tool 45 can be removed and used separately. Thus the contacting surfaces of the cavity 47*a* and the tapered profile 42*a* can be molded through a conventional technique so that they can be removably engaged.

The brushing or daubing body 46 is preferably an object having the brushing or daubing function, for example, brush hair, rubber strip, steel wire, sponge, polyester fiber, cotton fiber, or non-woven fabric. The brushing or daubing body 46 shown in the drawing is exemplified by a plurality of brush hairs 48 disposed on the top of the body 45*a*.

The integral axial cross-section of the brushing or daubing body 46 can be molded into different geometrical shapes suitable for the brushing or daubing operation according to the type and dispensing requirement of the liquid 99 filled in the container, for example, circular, elliptic, or polygonal shape.

The dimension of each part of the cleaning tool 45 can be increased or reduced with reference to the dimension shown in the drawing according to the type and dispensing requirement of the liquid 99 filled in the container. For example, the dimension of the coupling portion 47 is axially extended to between 15 mm and 50 mm, so that the user can hold the cleaning tool 45 in the hand by using the coupling portion 47 as a handle and use the cleaning tool 45 separately.

In order to be suitable for more applications, the atomizing nozzle 72 of this embodiment has an outer diameter identical to that of the outflow nozzle 42, and the atomizing nozzle 72 has a tapered profile 72*a* identical to the tapered profile 42*a* of the outflow nozzle 42, so that the cleaning tool 45 can be further dismountably fitted with the atomizing nozzle 72 (as shown in FIG. 4B).

The cleaning tool 45 further includes an opening 49 having a lip portion 49*a* which is formed above a central axial direction of the cavity 47*a*. When the cleaning tool 45 is fitted with the outflow nozzle 42 or the atomizing nozzle 72, the outflow nozzle 42 or the atomizing nozzle 72 can pass through the opening 49, and the lip portion 49*a* can be liquid-tightly attached to the peripheral surface of the outflow nozzle 42 or the atomizing nozzle 72, thus preventing the released liquid from leaking from the outer periphery of the outflow nozzle 42 or the atomizing nozzle 72 in reverse direction (as shown in FIG. 4A or 4B).

As for the operations of the auxiliary dispenser of the atomizer 40, as shown in FIG. 4A, the cleaning tool 45 is fitted with the outflow nozzle 42, and the operations and advantages thereof are approximately the same as those of the atomizer 30 of FIG. 3A.

As shown in FIG. 4B, the cleaning tool 45 is fitted with the atomizing nozzle 72. In use, the user first makes the brushing or daubing body 46 approach the object W2 on the lateral side, then pulls the trigger 8 to actuate the pump; under the pumping force of the pump, the liquid 99 in the container is atomized from the atomizing nozzle 72 along the direction indicated by the arrow, and the atomized liquid 99 can pass through the hollow part 46*a* of the brushing or daubing body 46 and dispensed to the object W2 on the lateral side.

The dispensing mode in which the cleaning tool 45 is fitted to the atomizing nozzle 72 can also be used to auxiliarily dispense the detergent to an upright operating area (for example, a wall surface of a bathroom or kitchen, surface of a mirror or equipment, or window glass), and the advantages thereof are described as follows. The atomizing nozzle 72 is surrounded by the brushing or daubing body 46, so that the atomized liquid is sprayed and dispensed to the upright operating area through the daubing function of the brushing or daubing body 46, and thus, the liquid does not easily drop downwards. In addition, through the brushing function of the brushing or daubing body 46, the dirt on the operating area can be cleaned, thereby enhancing work efficiency. More importantly, through the shielding function of the brushing or daubing body, the atomized detergent particles are prevented from spreading in the air, so as to preserve the user's health.

Figure 5:
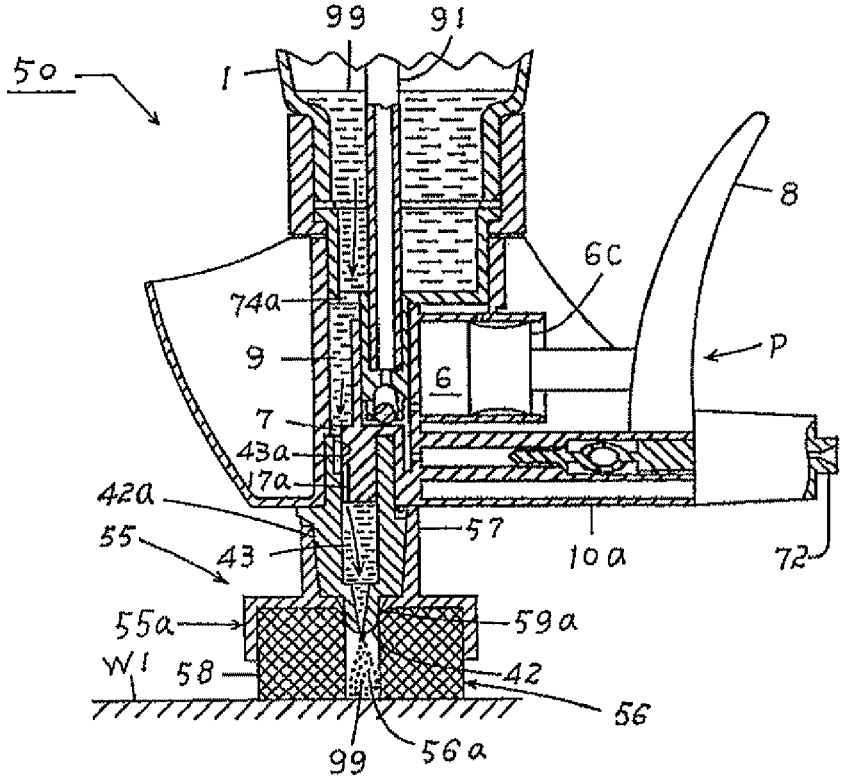
FIG. 5 shows a fifth preferred embodiment of the present invention, in which the brushing or daubing body in a form of a sponge is disposed on the body of a cleaning tool.
Figure 5A:
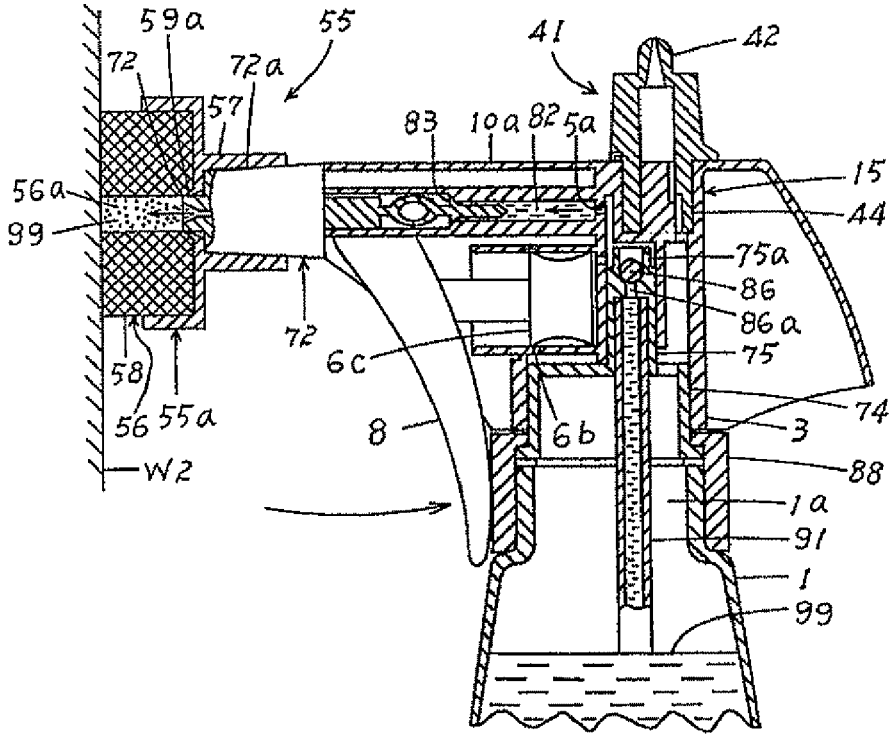
FIG. 5A shows the cleaning tool in FIG. 5 fitted on the atomizing nozzle.

FIGS. 5 and 5A show an atomizer 50 according to a fifth preferred embodiment which is similar to that of FIG. 4, except that a sponge 58 is selected for the brushing or daubing body 56 of this embodiment and is disposed on a body 55*a* of a cleaning tool 55.

The sponge 58 is similar to the sponge 38 in FIG. 3, but the sponge 58 of this embodiment has a hollow part 56*a*, so that when the cleaning tool 55 is fitted with the atomizing nozzle 72, the liquid released from the atomizing nozzle 72 can be sprayed through the hollow part 56*a*.

Figure 6:
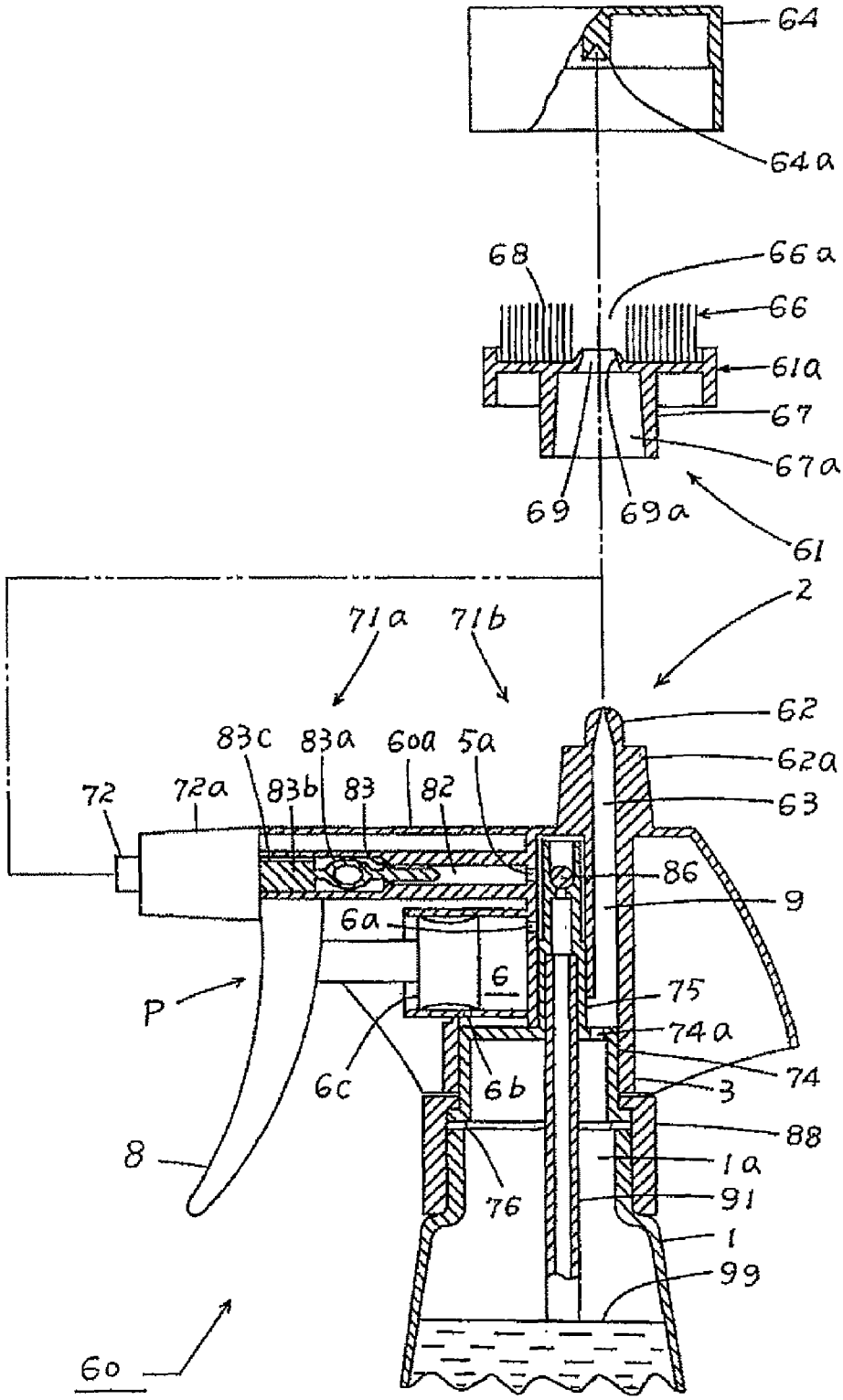
FIG. 6 shows a sixth preferred embodiment of the present invention, in which the connecting member is provided at the second outlet of the atomizer body in a form of the outflow nozzle, and a dispensing unit is ready to couple with the outflow nozzle or the atomizing nozzle.
Figure 6A:
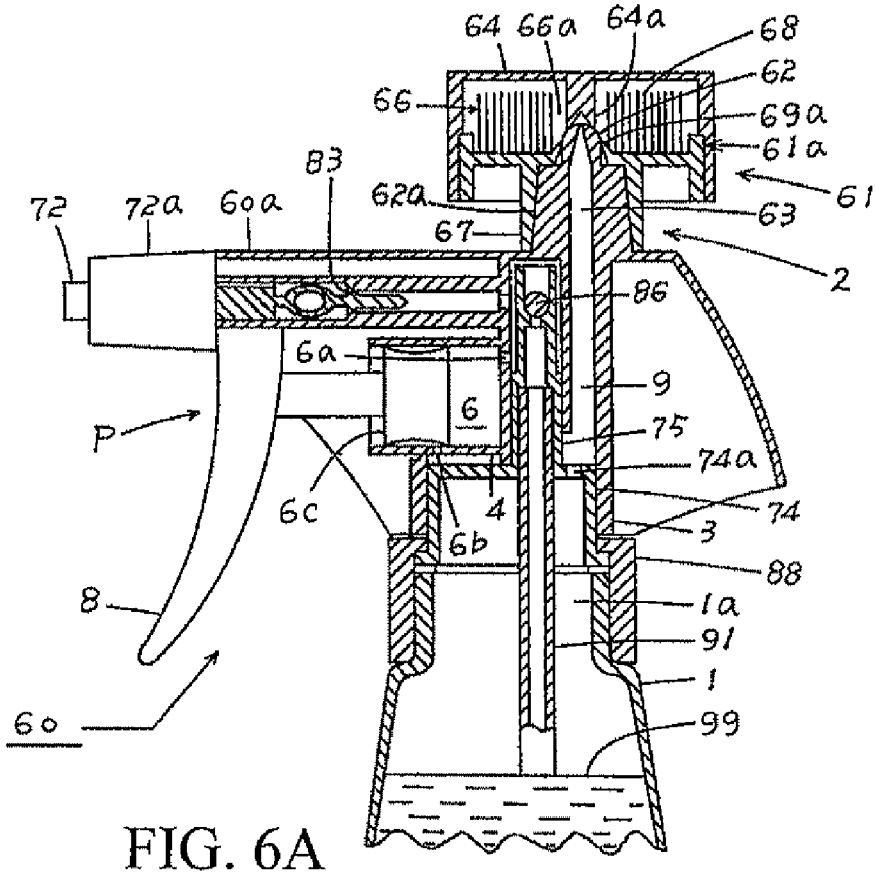
FIG. 6A shows the dispensing unit in FIG. 6 coupled with a outflow nozzle, in which the dispensing unit has a cap.

FIGS. 6 and 6A show an atomizer 60 according to a sixth preferred embodiment which is similar to that of FIG. 1, except that a coupling portion 67 of he dispensing unit 61 in this embodiment is fitted with the connecting member 2. In addition, the connecting member 2 axially protrudes upwards from the top of the atomizer body 60*a* in the form of an outflow nozzle 62. The outflow nozzle 62 is axially provide with a hole 63 in communication with the outflow path 9, so that the liquid is directly dispensed from the opening of the outflow nozzle 62.

Some parts of the atomizer 60 in this embodiment are similar to those of the atomizer 40 in FIG. 4, For example, the outflow nozzle 62 has a circular cross-section and a tapered profile 62*a*. The atomizing nozzle 72 has an outer diameter identical to that of the outflow nozzle 62, and the atomizing nozzle 72 has a tapered profile 72*a* identical to the tapered profile 62*a* of the outflow nozzle 62. In addition, a brushing or daubing body 66 is disposed on the top of a body 61*a* of the dispensing unit 61, the coupling portion 67 of the dispensing unit 61 has a cavity 67*a* to be removably fitted with the tapered profiles 62*a* and 72*a*, and an opening 69 with a lip portion 69*a* is formed at the top of the cavity 67*a*, so that the dispensing unit 61 can be fitted with the outflow nozzle 62 or the atomizing nozzle 72.

The dispensing unit 61 further includes a cap 64 having a sealing element 64*a*. When the cap 64 covers the brushing or daubing body 66, the sealing element 64*a* seals the opening of the outflow nozzle 62 at the same time (as shown in FIG. 6A).

The operations and functional advantages of the auxiliary dispenser of the atomizer 60 in this embodiment are similar to those of the atomizer 40 in FIG. 4, and so can be understood with reference to the descriptions of the atomizer 40.

The atomizer of the present invention has an auxiliary dispenser, so when the level of the liquid 99 in the container is so low that the suction pipe 91 cannot reach the liquid, the auxiliary dispenser can be used in order to exhaust the liquid. In this manner, not only is the liquid not wasted, but also the container will not have any residual liquid left therein, thereby meeting the environmental protection requirement.

The manufacturing method of the atomizers 10, 20, 30, 40, 50, and 60 with the auxiliary dispenser is described below. In view of the structure and operations described in the above embodiments with reference to the accompanying drawings, it can be understood that the atomizer is designed by adopting a modularization concept. The connecting member 2 of the auxiliary dispenser is disposed on the atomizer body, which serves as a basis for modularization of device so that a series of dispensing units with different functions and shapes can be coupled to the connecting member 2. The manufacturing method includes the following steps.

First, the atomizer body is manufactured by forming the atomizer bodies 10*a* and 60*a* with plastic injection molding. The atomizer bodies 10*a* and 60*a* are similar to the conventional atomizer 80 in FIG. 7 and have similar pipelines and members. In addition to the first outlet 71*a* for the trigger-actuated pumping and atomizing dispenser, the atomizer bodies 10*a* and 60*a* further include a second outlet 71*b* and an outflow path 9 for the auxiliary dispenser. The second outlet 71*b* is disposed on the upper parts of the atomizer bodies 10*a* and 60*a*, and is provided with holes 7 and 63, so as to be in fluid communication with the outflow path 9. The connecting member 2 (for example, the cylindrical slot 15 of FIGS. 1 to 5 or the outflow nozzle 62 of FIG. 6) of the auxiliary dispenser is integrally mounted at the position of the second outlet 71*b*.

Then, the parts of the conventional trigger-actuated pumping and atomizing dispenser are manufactured.

The above parts are assembled on the atomizer bodies 10*a* and 60*a*, and thus, the atomizer already has the dispensing function of the trigger-actuated pumping and atomizing atomizer.

Then, the dispensing unit is manufactured by producing a series of dispensing units 11, 21, 31, 41, and 61 with dispensing functions according to the types and preferred dispensing manners of different liquids. It should be noted that, according to the above embodiments, the series of dispensing units must include the coupling portions 14, 24, 34, 44, and 67 for being coupled to the connecting member 2.

Then, the dispensing unit is assembled, in which the coupling portion of the dispensing unit is coupled to the connecting member 2 (for example, the cylindrical slot 15 or the outflow nozzle 62), so as to assemble the dispensing unit at the position of the second outlet 71*b* of the atomizer.

Then, the atomizer is coupled to the container through a conventional technique.

The advantages of the manufacturing method are described as follows. The connecting member 2 and the outflow path 9 of the auxiliary dispenser and the atomizer body are molded at the same time, but the cost is not increased at all. The structure of the dispensing unit is quite simple, so it is suitable for mass production of a series of dispensing units at a low cost. In addition, the dispensing unit is assembled on the atomizer body in a simple manner from top to bottom, so the assembling cost is rather low. In this manner, the manufacturer only needs to manufacture atomizers with the connecting member and the outflow path in addition to a series of dispensing units. The specific dispensing unit required for each order is coupled to the connecting member before product delivery, thus enabling easy mass production of a series of atomizers having auxiliary dispensers at a low cost.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

We claim:

1. An atomizer capable of being coupled to a container filled with a liquid, comprising a conventional trigger-actuated pumping and atomizing dispenser for dispensing the liquid via an atomizing nozzle and characterized in having an auxiliary dispenser, wherein the auxiliary dispenser comprises:

a connecting member, integrally configured on an upper part of an atomizer body, and provided with a hole;

an outflow path, connected outwards to the hole and connected inwards to an inner part of the container; and a dispensing unit, comprising a coupling portion capable of being coupled to the connecting member, so as to dispense the liquid released from the hole, wherein the connecting member is formed on the atomizer body in the form of a cylindrical slot, the coupling portion of the dispensing unit is coupled to the cylindrical slot by means of insertion, and the dispensing unit further comprises: an outflow nozzle, integrally formed with the coupling portion, and a cavity, connecting the coupling portion and the outflow nozzle, so that the liquid released from the hole is dispensed from the cavity.

2. The atomizer according to claim 1, wherein the dispensing unit further comprises a radial hole in communication with the cavity, and the diameter of the radial hole is between 1 mm and 6 mm.

3. The atomizer according to claim 1, wherein the dispensing unit further comprises a radial hole in communication with the cavity, and the diameter of the radial hole is between 0.1 mm and 1 mm.

4. The atomizer according to claim 1, wherein the dispensing unit further comprises: a hollow holder surrounding the outflow nozzle, and a brushing or daubing body disposed within the hollow holder.

5. The atomizer according to claim 4, wherein the brushing or daubing body is removable, and is selected from a group consisting of brush hair, rubber strip, steel wire, sponge, polyester fiber, cotton fiber, or non-woven fabric.

6. The atomizer according to claim 1, wherein the outflow nozzle and the atomizing nozzle have identical tapered profile and the auxiliary dispenser further comprises a cleaning tool, the cleaning tool further comprising a coupling portion removably fitted with the tapered profile.

7. The atomizer according to claim 6, wherein the cleaning tool further comprises a brushing or daubing body, and the brushing or daubing body is selected from a group consisting of brush hair, rubber strip, steel wire, sponge, polyester fiber, cotton fiber, or non-woven fabric.

8. The atomizer according to claim 6, wherein the cleaning tool further comprises a lip portion liquid-tightly attached to a peripheral surface of the outflow nozzle or the atomizing nozzle.

9. The atomizer according to claim 1, wherein the auxiliary dispenser further comprises a flow path opening/closing mechanism for changing the open/closed state of a flow path between the hole and the cavity by rotating the dispensing unit.

10. The atomizer according to claim 9, wherein the flow path opening/closing mechanism comprises an inner-edge channel and an outer-edge channel, wherein both the inner-edge channel and the outer-edge channel are aligned or staggered by rotating the dispensing unit so that when the two channels are aligned with each other, the hole is in communication with the cavity through the two channels, and when the two camels are staggered, the flow path between the hole and the cavity is shut off.

11. The atomizer according to claim 2, wherein the connecting member is formed on the atomizer body in the form of an outflow nozzle, and the hole is in communication with the outflow nozzle and is connected inwards to the outflow path.

12. The atomizer according to claim 11, wherein the dispensing unit further comprises a brushing or daubing body, and the material of the brushing or daubing body is selected from a group consisting of brush hair, rubber strip, steel wire, sponge, polyester fiber, cotton fiber, or non-woven fabric.

13. The atomizer according to claim 11, wherein the outflow nozzle and the atomizing nozzle have identical tapered profile, and the coupling portion of the dispensing unit is removably fitted with the tapered profile.

14. The atomizer according to claim 13, wherein the dispensing unit further comprises a lip portion liquid-tightly attached to a peripheral surface of the outflow nozzle or the atomizing nozzle.

15. The atomizer according to claim 1, wherein the liquid is selected from a group consisting of detergent, rinsing agent, brightener, deodorant, disinfectant, insecticide, horticultural cultivation agent, flavoring agent, food seasoning, cutting compound, lubricant, release agent, rust remover, or antirust agent.

16. A manufacturing method of an atomizer having an auxiliary dispenser, wherein the atomizer is coupled to a container filled with a liquid, and the auxiliary dispenser comprises: a connecting member disposed on an atomizer body, and a dispensing unit coupled to the connecting member for dispensing the liquid, the manufacturing method comprising:

manufacturing the atomizer body by plastic injection molding, wherein the atomizer body comprises a second outlet and an outflow path, and the connecting member is integrally formed at the position of the second outlet;

manufacturing parts of a conventional trigger-actuated pumping and atomizing dispenser;

assembling the parts on the atomizer body;

manufacturing the dispensing unit, wherein the dispensing unit comprises a coupling portion for coupled with the connecting member;

assembling the dispensing unit, wherein the coupling portion is coupled with the connecting member, so as to assemble the dispensing unit at the second outlet; and coupling the atomizer with the container, wherein the connecting member is a cylindrical slot which is axially recessed, and the second outlet is in communication with the bottom wall of the cylindrical slot through a hole, so as to connect to the outflow path.

17. The manufacturing method according to claim 16, wherein the connecting member is an outflow nozzle axially protruding upwards, and the second outlet is in communication with the outflow nozzle through a hole, so as to connect to the outflow path.

18. The manufacturing method according to claim 16, wherein the coupling portion is coupled with the cylindrical slot by means of insertion.

19. The manufacturing method according to claim 17, wherein the coupling portion is coupled with the outflow nozzle by means of fitting.

20. The manufacturing method according to claim 16, wherein the dispensing unit further comprises an outflow nozzle for dispensing the liquid.

21. The manufacturing method according to claim 16, wherein the dispensing unit further comprises a radial releasing portion for radially dispensing or atomizing the liquid.

22. The manufacturing method according to claim 16, wherein the dispensing unit further comprises a brushing or daubing body for dispensing the liquid.

23. The manufacturing method according to claim 22, wherein the brushing or daubing body is selected from a group consisting of brush hair, rubber strip, steel wire, sponge, polyester fiber, cotton fiber, or non-woven fabric.

24. The manufacturing method according to claim 16, wherein the liquid is selected from a group consisting of detergent, rinsing agent, brightener, deodorant, disinfectant, insecticide, horticultural cultivation agent, flavoring agent, food seasoning, cutting compound, lubricant, release agent, rust remover, or antirust agent.

* * * * *